United States Patent [19]

Weiler

[11] 4,153,387

[45] May 8, 1979

[54] COVER ARRANGEMENT FOR RADIAL ROTORS OF TURBO MACHINES SUCH AS GAS TURBINE ENGINES

[75] Inventor: Wolfgang Weiler, Dachau, Fed. Rep. of Germany

[73] Assignee: MTU München GmbH, Fed. Rep. of Germany

[21] Appl. No.: 772,679

[22] Filed: Feb. 28, 1977

[30] Foreign Application Priority Data

Feb. 26, 1976 [DE] Fed. Rep. of Germany ..... 2607776

[51] Int. Cl.[2] ..... F01D 1/00

[52] U.S. Cl. ..... 415/219 C; 415/219 R

[58] Field of Search ..... 415/219 C, 219 R, 136, 415/138, 219 A, 219 B, 219 C, 219 R

[56] References Cited

U.S. PATENT DOCUMENTS

| | | | |
|---|---|---|---|
| 2,312,422 | 3/1943 | Kumlin | 415/219 C |
| 2,404,609 | 7/1946 | Whittle | 415/219 C |
| 3,043,559 | 7/1962 | Bauer et al. | 415/138 |
| 3,498,727 | 3/1970 | Martin | 415/219 R |
| 3,628,884 | 12/1971 | Mierley | 415/219 R |

FOREIGN PATENT DOCUMENTS

| | | | |
|---|---|---|---|
| 2607776 | 1/1977 | Fed. Rep. of Germany | 415/219 R |

*Primary Examiner*—C. J. Husar
*Attorney, Agent, or Firm*—Craig & Antonelli

[57] ABSTRACT

A cover arrangement is provided for covering radial rotors of turbo machines such as impellers of gas turbine engines. The arrangement includes two cover halves extending respectively one half of the circumferential distance around the impeller rotor and connected at the edge portions by connecting flanges. In order to accommodate a balancing of the cover arrangement and uniform spacing between the cover arrangement and the impeller, the cover halves are provided with rib portions which are evenly spaced around the perimeter and which are shaped and configured similarly to the connecting flanges. In preferred embodiments, the rib members and the connecting flanges are constructed with similar moments of inertia, thermal capacities, and bending resistances, to further assure uniformity around the periphery of the cover arrangement. In particularly preferred embodiments, each cover half includes two rib portions between the respective edge connecting flanges, which are equally spaced from one another and the flanges. In preferred embodiments, the cover halves are carried by the machine casing via bolts supported at the casing and extending through collar-shaped wall sections equally spaced around the perimeter of the cover arrangement at the cover halves.

23 Claims, 4 Drawing Figures

COVER ARRANGEMENT FOR RADIAL ROTORS OF TURBO MACHINES SUCH AS GAS TURBINE ENGINES

BACKGROUND AND SUMMARY OF THE INVENTION

The invention relates to a cover for radial rotors of turbo machines, which cover is divided in parts along a dividing plane. In preferred embodiments, the turbo machine is a gas turbine engine and the dividing plane extends radially of and includes the rotational axis of the radial rotor.

Such covers are frequently configured as undivided structures, the wall thickness of which is uniform over the whole perimeter. The reason for this is to ensure small gaps, as uniform as possible over the whole perimeter, between the radial rotor and the cover, such gaps having a decisive effect on the efficiency and surge line behaviour of highly stressed machines, e.g., radial compressors in aero gas turbines.

This mode of construction is admittedly disadvantageous for balancing and the smooth running of the machine in the case of multi-stage machines and where axial and radial stages are combined within one machine component. Also, there are disadvantages with regard to the manufacturing and assembly costs for such undivided one-piece cover structures.

Covers are also known which are separable along a dividing or meridian plane. However, previously contemplated designs exhibit shortcomings in that non-uniform distribution of material around the perimeter—resulting, for instance, from material massed in the dividing plane at connecting flanges or the like—provides variable rigidity and variable thermal capacities around the perimeter of the cover.

Particularly in non-steady operating conditions, this variable rigidity and variable thermal capacity leads to deformation in the individual meridian planes (radial planes including the rotor axis of rotation) of the cover and consequently to negative effects on the performance and operating behavior of the turbo machine in question.

An important object of the invention is to eliminate the above-mentioned disadvantages and to devise a cover arrangement which is separable in one meridian dividing plane for the radial rotors being covered and which will ensure a constant radial gap between the radial rotor and the cover under all operating conditions.

To solve the given tasks, a primary proposal in the invention is that, starting from the meridian or dividing plane, supporting ribs are attached on the outside wall of the cover in several other meridian planes spaced evenly around the perimeter; the shape of these ribs corresponding to the flanges in the dividing plane.

The area moment of inertia and thermal storage capacity of the ribs preferably have corresponding values for the flanges in the dividing plane. At the same time, bending resistance of the ribs is preferably matched to the flanges in the dividing plane to guarantee constant gaps around the perimeter, above all under steady-state operating conditions. Thermal storage capacity of the ribs matched to the flanges in the dividing plane provides for constant gaps around the perimeter, above all under non-steady-state operating conditions, e.g., when load changes are abrupt.

In a further elaboration of preferred embodiments of the invention, the attached ribs are combined with the flanges to form a type of skeleton, so that the part of the cover directly adjacent the rotor is practically kept free from structural support functions.

In a further elaboration of preferred embodiments of the invention, the cover is connected with the turbo machine casing by a number of radially disposed bolts. By this means, the cover is kept completely free from forces and deformations resulting from the structure of the machine. This automatically leads to a reduction of the gap variations between rotor and cover.

If, in addition, the thermal storage capacity of the cover is matched to that of the rotor, the gaps in operation can be kept small even when load changes are abrupt.

In particularly preferred embodiments, the connecting flanges and the rib members or portions form a symmetric configuration around the periphery of the rotor.

These and further objects, features and advantages of the present invention will become more obvious from the following description when taken in connection with the accompanying drawings which show, for purposes of illustration only, several embodiments in accordance with the present invention.

DETAILED DESCRIPTION OF THE DRAWINGS

Figure 1:
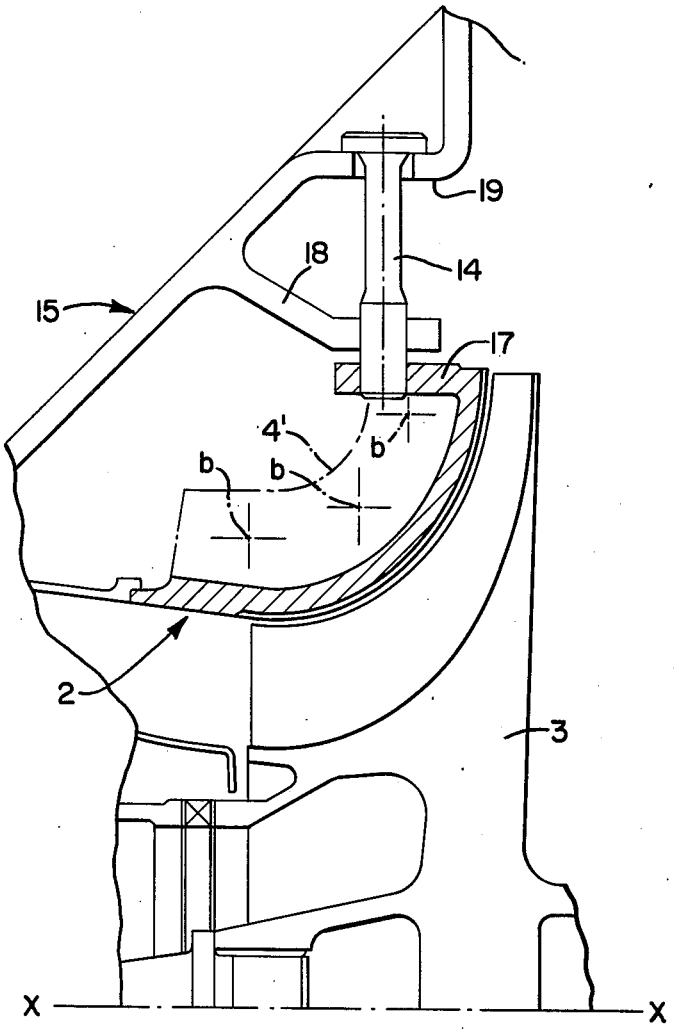
FIG. 1 is a schematic partial central longitudinal sectional view through a radial compressor impeller stage of a gas turbine engine which is provided with a cover arrangement for the radial impeller constructed in accordance with a preferred embodiment of the invention.

In the drawings and the specification, only those portions of the turbo machine (gas turbine engine) as are necessary to an understanding of the invention are illustrated and described. In this manner, the cover arrangement of the present invention is not unduly obscured by other structures. Those skilled in the art should readily be able to practice the invention, given the state of the art and this disclosure.

Figure 2:
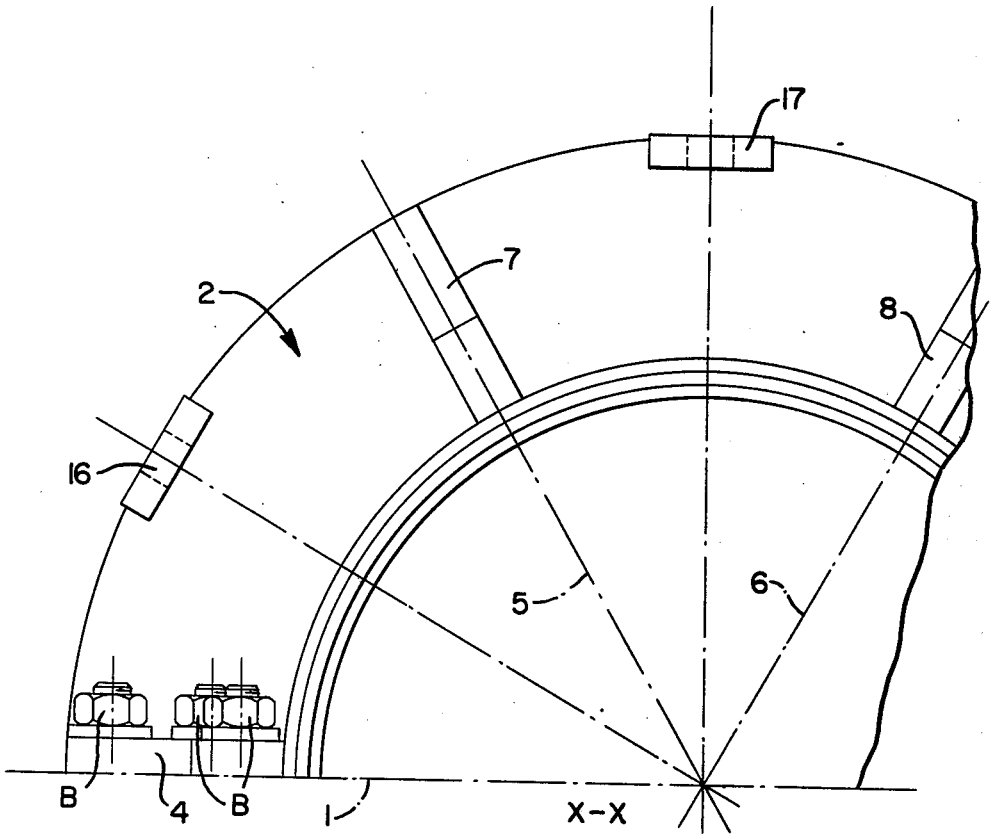
FIG. 2 is a partial front view of the upper cover half of the cover arrangement shown in FIG. 1.

FIGS. 1 and 2 show a cover arrangement, divided in the dividing or meridian plane 1 (through and including rotational axis x—x of impeller 3), for a radial compressor impeller 3 of a gas turbine engine, the halves 2 of the cover being joined by means of flanges 4 and bolts B therethrough. In FIG. 1, the profile 4' of a flange 4 and the positions b for holes to accommodate bolts B are shown in dash-dot lines.

In several other meridian planes 5 and 6 spaced evenly around the perimeter starting from the meridian or dividing plane, supporting ribs 7 and 8 are provided on the outside wall of the cover 2, the shape of these ribs corresponding to the shape of flanges 4 in the dividing plane. The contour 4' of the flange 4 projected as shown in the drawing plane in FIG. 1 accordingly corresponds to the contour of the supporting ribs 7, 8. In FIG. 2 only a portion of the upper cover half 2 is shown, it being understood that the completed joined cover arrangement will include symmetrically arranged connecting flanges 4 along plane 1 and ribs along planes 5 and 6 (in both cover halves).

The area moment of inertia, thermal storage capacity and bending resistance of the supporting ribs 7, 8 is matched to the corresponding characteristics of the flanges 4 to form a cover arrangement which is uniformly balanced around the periphery of the impeller 3, even though formed of multiple parts flangedly connected together.

Figure 3:
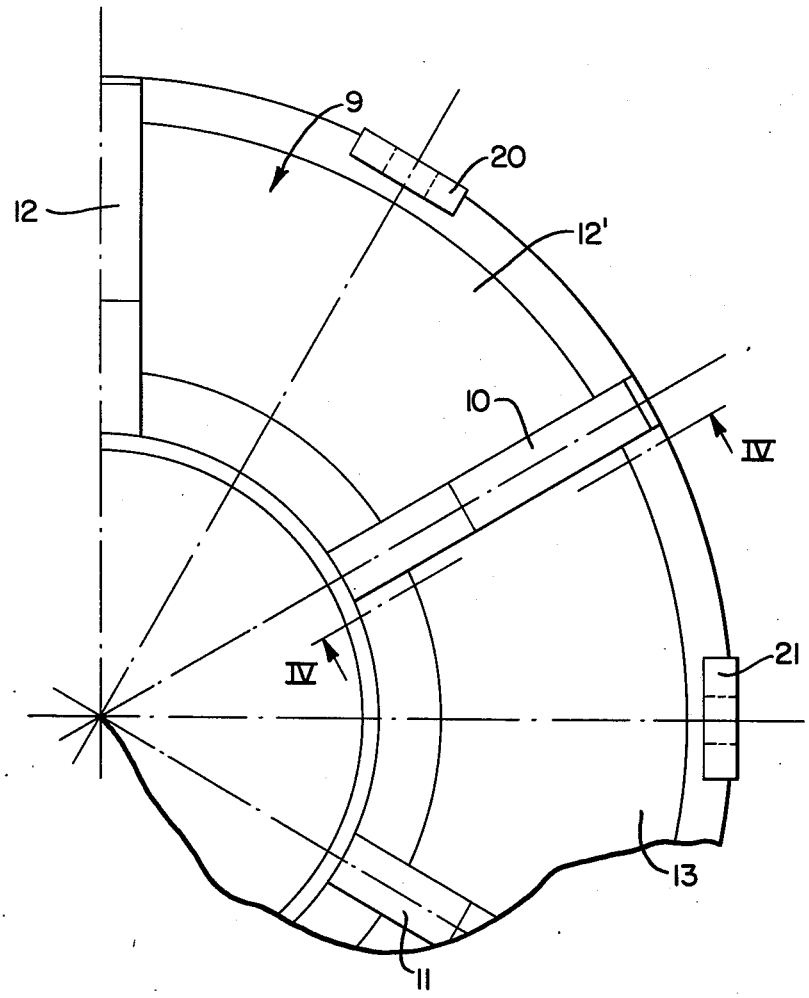
FIG. 3 is a partial front view, similar to FIG. 2, but showing a second preferred embodiment of the invention.
Figure 4:
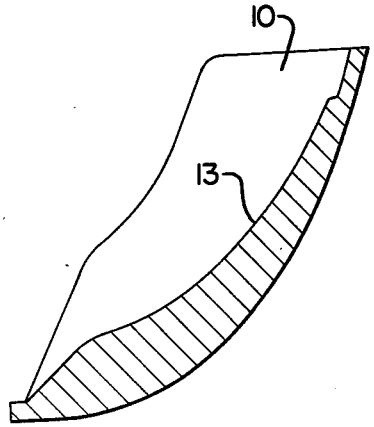
FIG. 4 is a partial sectional view along line IV—IV in FIG. 3.

FIGS. 3 and 4 illustrate another embodiment wherein, on each cover half 9 the supporting ribs 10, 11 and the connecting flanges 12 are combined to form a type of skeleton by means of connecting webs 12', 13 between a flange 12 and a rib 10 and between two ribs 10, 11 in each case.

The cover half 9 including the ribs 10, 11, the flanges 12 and the connecting web 12', 13 are preferably manufactured as an integral casting. The same applies analogously to preferred embodiments of the version in FIG. 2.

As can further be seen from FIGS. 1 and 2, the cover 2 is preferably connected with the casing 15 of the gas turbine engine by several radially disposed bolts 14 spaced evenly around its perimeter. The bolts 14 are fastened to collar-shaped wall sections 16, 17 of the cover 2 and are located and supported in overhanging projections 18, 19 of the casing 15 of the engine. In this manner, the cover arrangement for the impeller is subject to a minimum of support functions which enhances its capability to retain dimensional stability and therewith uniform spacing from the impeller during various operating stages of the engine. Corresponding collar-shaped wall sections for fastening such bolts are shown as 20 and 21 in the FIG. 3 embodiment.

The collar-shaped wall sections 16, 17 (FIGS. 1 and 2) and 20, 21 (FIG. 3) can likewise be manufactured together with the cover 2 or cover half 9 as part of the casting according to particularly preferred embodiments of the invention.

It is also of particular advantage according to preferred forms of the invention if the thermal storage capacity of the cover is matched in each case to that of the rotor.

The cover arrangement described herein is suitable not only for radial compressor impellers or turbine rotors per se of turbo machines, e.g., gas turbine engines or gas turbine jet engines, but also for combined radial-axial compressors or turbine rotors of such turbo machines named by way of example.

It is also contemplated, for instance, to provide radial bladed turbo superchargers with the cover arrangement described and claimed herein.

While I have shown and described several embodiments in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. Cover arrangement for radial rotors of turbo machines, such as gas turbine engines, said arrangement comprising:

cover parts joined together by connecting flanges along a dividing plane extending through a central axis, said central axis being aligned with a rotational axis of a radial rotor when said cover parts are in a position covering the radial rotor;

and supporting rib means carried by said cover parts, said supporting rib means being spaced around a perimeter of the cover parts;

wherein the area moments of inertia of the supporting rib means are matched to the area moments of inertia of the connecting flanges to assist in insuring a constant radial gap between the radial rotor and the cover parts during operating conditions.

2. Cover arrangement according to claim 1, wherein said supporting rib means are spaced evenly around the perimeter of the cover arrangement and are shaped similarly to the connecting flanges, and wherein said supporting rib means includes a plurality of supporting rib portions fixedly connected to each of said cover parts, said supporting rib portions extending radially along meridian planes through said central axis.

3. Cover arrangement according to claim 2, wherein area moments of inertia of the supporting rib portions are matched to area moments of inertia of the connecting flanges.

4. Cover arrangement according to claim 2, wherein thermal storage capacities of the supporting rib portions are matched to thermal storage capacities of the connecting flanges.

5. Cover arrangement according to claim 2, wherein bending resistances of the supporting rib portions are matched to bending resistances of the connecting flanges.

6. Cover arrangement according to claim 3, wherein thermal storage capacities of the supporting rib portions are matched to thermal storage capacities of the connecting flanges.

7. Cover arrangement according to claim 6, wherein bending resistances of the supporting rib portions are matched to bending resistances of the connecting flanges.

8. Cover arrangement according to claim 2, wherein said cover parts consist of two cover halves, and wherein, on each cover half, the supporting rib portions and the connecting flanges are combined to form a type of skeleton.

9. Cover arrangement according to claim 7, wherein said cover parts consist of two cover halves, and wherein, on each cover half, the supporting rib portions and the connecting flanges are combined to form a type of skeleton.

10. Cover arrangement according to claim 2, wherein said means for permanently ensuring a constant radial gap includes radially disposed bolt means for fastening the cover parts to a casing of a turbo machine.

11. Cover arrangement according to claim 7, wherein said means for permanently ensuring a constant radial gap includes radially disposed bolt means for fastening the cover parts to a casing of a turbo machine.

12. Cover arrangement according to claim 8, wherein said means for permanently ensuring a constant radial gap includes radially disposed bolt means for fastening the cover parts to a casing of a turbo machine.

13. Cover arrangement according to claim 10, wherein the bolt means are fastened to collar-shaped wall sections of the cover parts and are located in overhanging projections of the casing.

14. Cover arrangement according to claim 11, wherein the bolt means are fastened to collar-shaped wall sections of the cover parts and are located in overhanging projections of the casing.

15. Cover arrangement according to claim 2, wherein thermal storage capacity of the cover parts is matched to that of the rotor.

16. Cover arrangement according to claim 7, wherein the thermal storage capacity of the cover parts is matched to that of the radial rotor.

17. Cover arrangement according to claim 14, wherein the thermal storage capacity of the cover parts is matched to that of the radial rotor.

18. Cover arrangement for radial rotors of turbo machines, such as gas turbine engines, said arrangement comprising:

cover parts joined together by connecting flanges along a dividing plane extending through a central axis, said central axis being aligned with a rotational axis of a radial rotor when said cover parts are in a position covering the radial rotor;

and supporting rib means carried by said cover parts, said supporting rib means being spaced around a perimeter of the cover parts;

wherein the thermal storage capacities of the supporting rib means are matched to the thermal storage capacities of the connecting flanges to assist in insuring a constant radial gap between the radial rotor and the cover parts during operating conditions.

19. Cover arrangement according to claim 18, wherein said supporting rib means are spaced evenly around the perimeter of the cover arrangement and are shaped similarly to the connecting flanges, and wherein said supporting rib means includes a plurality of supporting rib portions fixedly connected to each of said cover parts, said supporting rib portions extending radially along meridian planes through said central axis.

20. Cover arrangement for radial rotors of turbo machines, such as gas turbine engines, said arrangement comprising:

cover parts joined together by connecting flanges along a dividing plane extending through a central axis, said central axis being aligned with a rotational axis of a radial rotor when said cover parts are in a position covering the radial rotor;

and supporting rib means carried by said cover parts, said supporting rib means being spaced around a perimeter of the cover parts;

wherein the bending resistances of the supporting rib means are matched to the bending resistances of the connecting flanges.

21. Cover arrangement according to claim 20, wherein said supporting rib means are spaced evenly around the perimeter of the cover arrangement and are shaped similarly to the connecting flanges, and wherein said supporting rib means includes a plurality of supporting rib portions fixedly connected to each of said cover parts, said supporting rib portions extending radially along meridian planes through said central axis.

22. Cover arrangement for radial rotors of turbo machines, such as gas turbine engines, said arrangement comprising:

cover parts joined together by connecting flanges along a dividing plane extending through a central axis, said central axis being aligned with a rotational axis of a radial rotor when said cover parts are in a position covering the radial rotor;

and supporting rib means carried by said cover parts, said supporting rib means being spaced around a perimeter of the cover parts;

wherein the thermal storage capacity of the cover is matched to that of the rotor.

23. Cover arrangement according to claim 22, wherein said supporting rib means are spaced evenly around the perimeter of the cover arrangement and are shaped similarly to the connecting flanges, and wherein said supporting rib means includes a plurality of supporting rib portions fixedly connected to each of said cover parts, said supporting rib portions extending radially along meridian planes through said central axis.

* * * * *